United States Patent [19]

Stubenrauch

[11] 4,277,991

[45] Jul. 14, 1981

[54] ADJUSTABLE SOCKET WRENCH

[76] Inventor: James B. Stubenrauch, 10701 Walmer, Overland Park, Kans. 66211

[21] Appl. No.: 94,982

[22] Filed: Nov. 16, 1979

[51] Int. Cl.[3] ..... B25B 13/16

[52] U.S. Cl. ..... 81/163; 81/170

[58] Field of Search ..... 81/163, 165, 170, DIG. 8

[56] References Cited

U.S. PATENT DOCUMENTS

| | | | |
|---|---|---|---|
| 1,047,046 | 12/1912 | Gronkowski | 81/163 |
| 2,600,617 | 6/1952 | Coates | 81/165 |
| 2,801,562 | 8/1957 | Stricklett et al. | 81/163 |

*Primary Examiner*—James G. Smith

*Attorney, Agent, or Firm*—Schmidt, Johnson, Hovey & Williams

[57] ABSTRACT

A double-jawed wrench head for use with a conventional socket wrench handle is disclosed which allows adjustment of jaw spacing so as to accommodate various sized nuts or lag bolts or the like using only a single head. The head preferably includes a pair of wrench jaws respectively shiftable by means of a worm gear and rack arrangement, with a polygonal aperture provided for receiving the drive stub or block of a socket wrench handle. The worm gear advantageously includes oppositely directed threaded sections for simultaneous shifting of the jaws toward and away from each other.

5 Claims, 6 Drawing Figures

FIG. 1
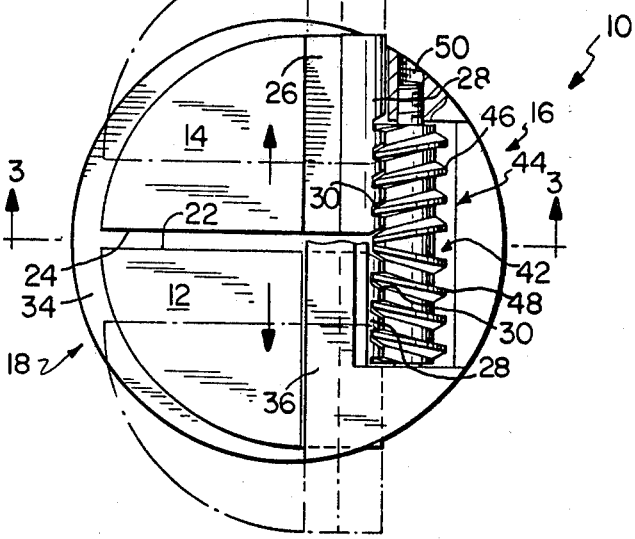
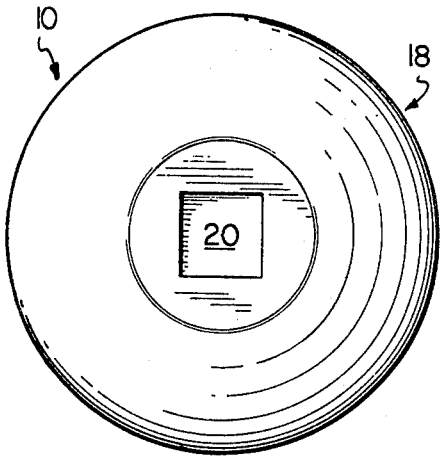
FIG. 2
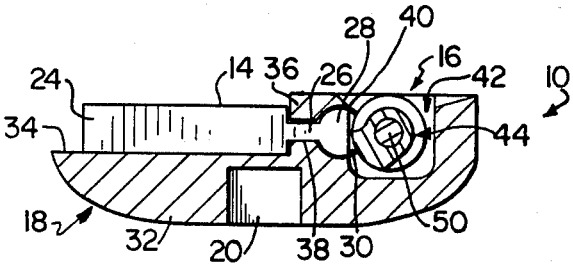
FIG. 3
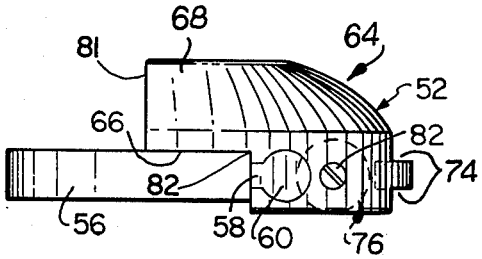
FIG. 4
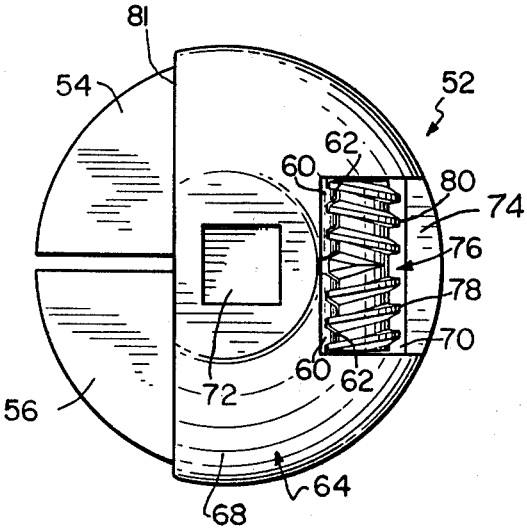
FIG. 5
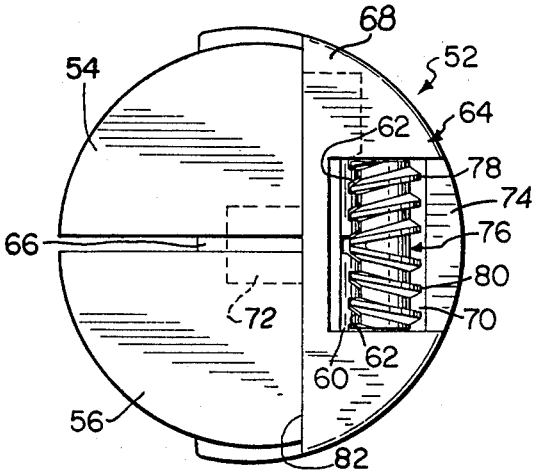
FIG. 6

ADJUSTABLE SOCKET WRENCH

BACKGROUND OF THE INVENTION

1. Field of the Invention

The present invention is concerned with an improved socket wrench head adapted for use with the usual socket wrench handle unit presenting an elongated handle and a polygonal (usually square), outwardly extending drive stub or shaft. More particularly, it is concerned with such an improved wrench head having a pair of adjustable jaws for allowing a single wrench head to be used on a variety of nuts or other workpieces.

2. Description of the Prior Art

Conventional socket wrench assemblies are of course well known. Generally speaking, such assemblies include an elongated handle equipped with an internal ratchet-type operating mechanism and an outwardly extending, polygonal drive stub or shaft. A series of tubular sockets are normally provided with the handle, and each of the sockets is designed to releasably receive the drive block of the wrench handle. Each socket furthermore is designed to fit over and engage a particular size lag bolt, nut or other workpiece.

In the use of such conventional socket wrench assemblies, a given socket is selected for use on a nut, and is snapped into place on the drive block of the handle. At this point the entire wrench assembly can be used in the usual fashion. However, if work must be performed on another nut or workpiece, it is necessary to remove the first socket and replace it with a properly sized socket. As can be appreciated, this interchange of sockets to accommodate various size nuts is a time consuming and sometimes tedious undertaking, particularly when, as in the case of automotive repairs, various nuts and the like are commonly encountered. Furthermore, as every experienced mechanic will attest, loss of sockets is extremely easy, primarily because of their tubular shape which permits the sockets to roll if dropped, and the fact that a large number of loose sockets must be maintained for even relatively simple jobs.

Adjustable or crescent wrenches are also well known. Such wrenches are normally of substantially unitary construction and are provided with an elongated handle and a movable jaw arrangement at one end of the handle. While such wrenches can be used on a variety of workpieces, they lack the usefulness of socket wrench assemblies, particularly in tight areas where space is at a premium.

SUMMARY OF THE INVENTION

The present invention overcomes the problems mentioned above and provides an adjustable socket wrench head adapted for use in conjunction with a conventional socket wrench handle having the usual drive block or stub. Broadly speaking, the wrench heads of the invention include a pair of wrench jaws, and means for selectively moving at least one of the jaws relative to the other jaw for adjusting the spacing between jaws. Structure is also provided for slidably supporting the jaws, and means, in the form of a recess, is provided for defining an opening for receiving the socket wrench drive block.

In preferred forms, a rack section is provided on each jaw, and an elongated, axially rotatable endless worm gear engages the rack sections. Advantageously, the worm gear has juxtaposed, oppositely directed helical thread sections thereon which respectively engage a corresponding rack section such that the jaws are moved towards and away from each other in unison, depending upon the direction of rotation of the worm gear.

The wrench jaws may slide upon a circular base plate, or in other forms the jaws may extend outwardly beyond the edge of the base plate. In the latter alternative, clearance is provided at the jaw area for gripping elongated objects such as pipes or the like intermediate the ends thereof.

BRIEF DESCRIPTION OF THE DRAWING

FIG. 1 is a fragmentary plan view of a wrench head in accordance with the invention, with the opening movement of the jaws thereof depicted in phantom;

FIG. 2 is a bottom view of the wrench head illustrated in FIG. 1;

FIG. 3 is a sectional view taken along line 3—3 of FIG. 1 which further illustrates the structure of the head;

FIG. 4 is a side elevational view of another adjustable socket wrench head in accordance with the invention;

FIG. 5 is a bottom view of the head depicted in FIG. 4; and

FIG. 6 is a plan view of the head depicted in FIG. 4.

DESCRIPTION OF THE PREFERRED EMBODIMENTS

Turning now to FIGS. 1–3, a socket wrench head 10 in accordance with the invention is illustrated. The head 10 includes a pair of wrench jaws 12 and 14, along with means broadly referred to by the numeral 16 for moving at least one of the jaws 12, 14 relative to the other jaw for adjusting the lateral spacing therebetween. Structure 18 is also provided for slidably supporting the jaws 12, 14 for the described relative movement, along with means for defining an opening 20 adapted to receive the drive block of a socket wrench handle.

In more detail, each of the jaws 12, 14, is somewhat sector-shaped in configuration and includes an elongated, substantially rectangular, workpiece engaging face 22, 24. Each of the jaws further includes an integral extension 26 and an elongated, arcuate rack section 28 presenting a series of spaced tooth-receiving indentations 30 along the length thereof.

Supporting structure 18 is in the form of an integral metallic plate 32 which is substantially circular in plan configuration and includes a planar, substantially semicircular, jaw-supporting region 34. The plate 30 is further provided with an upstanding block portion 36 having an elongated channel 38 therethrough terminating in an elongated, arcuate zone 40 (see FIG. 3). The extensions 26 of the respective jaws 12, 14, extend into and through the channel 38, whereas the respective rack sections 28 ride within the zone 40 as will be explained hereinafter. The structure 18 also includes an open-top channel 42 within the block portion 36 and adjacent the arcuate zone 40. Finally, the face of plate 32 remote from the region 34 is provided with inwardly extending walls defining the opening 20.

Moving means 16 includes, in addition to the respective rack sections 28, an elongated, axially rotatable worm gear 44 presenting a pair of juxtaposed, helically threaded sections 46, 48 along the length thereof. It will be observed (see FIG. 1) that the gear 44 is rotatably mounted within the block portion 36 by means of elongated shaft 50, and that the helical teeth of the sections 46, 48 are respectively received within the indentations 30 on the corresponding adjacent rack sections 28. Finally, it will be seen that the helical threading on the respective sections 46, 48 extends in opposite directions relative to one another; the importance of this feature will be made clear hereinafter.

Turning now to FIGS. 4–6, a second embodiment of the invention will be discussed. In particular, an adjustable socket wrench head 52 is illustrated which includes a pair of sector-shaped, shiftable jaws 54, 56 which are identical with the jaws 12, 14. Each jaw is provided with an elongated extension 58 terminating in an elongated rack section 60 having a series of spaced indentations 62 along the length thereof.

An integral plate 64 also forms a part of the head 52, and is provided with a planar, jaw-supporting surface 66, along with a main body portion 68 having an elongated, generally rectangular, worm gear-receiving opening 70 therethrough. The face of plate 64 remote from and directly opposed to the surface 66 is provided an opening 72 therein identical to opening 20. In addition, the plate is relieved as at 74 to facilitate finger access to the opening 70.

An elongated, dual-section worm gear 76 is operatively disposed within the opening 70 and includes respective, oppositely directed helically threaded sections 78, 80. The gear 76 is rotatably mounted within the opening 70 by means of elongated shaft 82, and the threads of the respective sections 78, 80 are operatively received within the indentations 62 on the corresponding rack sections 60.

It will be observed that the jaws 54, 56 are partially received within a relieved portion of main body 68 defined by surfaces 66 and oppositely extending surfaces 81, 82 respectively at the outer and inner ends of the surface 66.

In the use of socket wrench head 10 illustrated in FIGS. 1–3, the head is first snapped into place on a conventional socket wrench handle. This involves merely grasping the head and inserting the drive block or stub associated with the handle into the opening 20. At this point the respective jaws 12, 14 can be adjusted to accommodate a particular lag bolt head or the like. That is to say, rotation of the worm gear 44 in a clockwise direction as viewed in FIG. 3 has the effect of simultaneously sliding open the jaws 12, 14, and thereby separating the faces 22, 24 thereof. When the proper spacing between the jaws has been approximated, the head is placed over the bolt head and a final tightening adjustment of the jaws about the workpiece is effected by counter rotation of the worm gear 44. Tightening or loosening of the lag bolt can then be accomplished in the usual fashion employing the socket handle for this purpose. When this operation is completed, the jaws are simply opened and the head removed from the bolt head.

Operation of the embodiment depicted in FIGS. 4–6 is identical to that described above. In this case however, the socket wrench handle drive block is inserted within the boss 72. Moreover, it will be observed that the outermost portions of the jaws 54, 56 extend outwardly beyond the outermost edge of the supporting plate, i.e., beyond the outer edge of the surface 66. In this way the head 54, 56 is particularly adapted for grasping pipes or other elongated objects at a point intermediate the ends thereof.

It will thus be seen that the present invention provides an adjustable wrench head for use with conventional socket wrench handle, and that a single head can be used on a wide variety of nuts or other workpieces. As such, problems associated with loss of individually sized sockets is eliminated, along with the necessity of interchanging the socket on a regular basis.

Having thus described the invention, what is claimed as new and desired to be secured by Letters Patent is:

1. An adjustable socket wrench head, comprising:

a main body presenting a top surface, a bottom surface, and structure defining an elongated relieved portion, said structure including a first surface disposed at a vertical level between and in general parallelism with said top and bottom surfaces and presenting an inner end and outer end;

a second surface extending downwardly from said top surface toward said outermost end of said first surface; and a third surface extending upwardly from said bottom surface toward the inner end of said first surface;

a pair of jaws disposed partially within said relieved portion and extending outwardly beyond said second surface, each jaw having an inner, elongated workpiece-engaging surface;

means for selective, lateral, back-and-forth movement of at least one of said jaws relative to the other jaw for adjusting the spacing between the jaws;

structure defining an opening through said top surface for receiving the drive block of a socket wrench handle, said workpiece-engaging surfaces and said first, second, and third surfaces cooperatively defining, when said jaws are opened, a first, inner, workpiece-receiving region bounded on four sides and defined by the inner portions of said gripping surfaces, and said first and third surfaces between the open jaws, and a second, open-ended workpiece-receiving region cooperatively defined by the outer portions of said gripping surfaces beyond said second surface, and the portion of said second surface between the open jaws.

2. The wrench head as set forth in claim 1 wherein said moving means includes means for alternately moving both of said jaws toward and away from each other.

3. The wrench head as set forth in claim 2 wherein said moving means comprises:

a rack section on each jaw; and an elongated, axially rotatable endless worm gear section operatively engaging each rack section for moving of the jaw associated therewith.

4. The wrench head as set forth in claim 3 wherein said gear sections are on a single gear, the threads on said sections running in different directions.

5. The wrench head as set forth in claim 1, said opening being centrally located relative to said jaws when the jaws are opened.

* * * * *